United States Patent [19]

Hasegawa

[11] 4,385,638

[45] May 31, 1983

[54] HAIR DYEING INSTRUMENT

[76] Inventor: Kinichi Hasegawa, 3543-2 Motoishikawa-cho, Midori-Ku, Yokohama-shi, Kanagawa-Ken, Japan

[21] Appl. No.: 281,896

[22] Filed: Jul. 9, 1981

[30] Foreign Application Priority Data

Jul. 29, 1980 [JP] Japan ..... 55-104078

[51] Int. Cl.[3] ..... A45D 19/00

[52] U.S. Cl. ..... 132/88.5

[58] Field of Search ..... 132/11 R, 9, 112, 88.5; D28/7, 10; 222/206, 214, 215, 220

[56] References Cited

U.S. PATENT DOCUMENTS 3,861,407 1/1975 Gabriele ..... D28/7

4,225,061 9/1980 Blake et al. ..... 222/214

*Primary Examiner*—Richard J. Apley

*Assistant Examiner*—George Yanulis

*Attorney, Agent, or Firm*—Wenderoth, Lind & Ponack

[57] ABSTRACT

A hair dyeing device provides the manual hair dyeing functions which permit a hair dyeing for each bundle of hairs to be completed in single operation, and comprises two separable outer housing segments to be engaged for use and two inner housing parts each to be accommodated for forward and backward sliding movement in the corresponding outer housing segments. The outer housing segments as combined form slits at the opposite ends and a longitudinal intermediate slit between the opposite slits, the opposite slits allowing a bundle of hairs to be guided therethrough. The inner housing parts each include a bellows to control the volume thereof, and a hair dye feeder which includes a hair dye container and a hair dyeing teeth array.

19 Claims, 11 Drawing Figures

HAIR DYEING INSTRUMENT

BACKGROUND OF THE INVENTION

1. Field of the Invention

The present invention relates generally to a hair dyeing instrument for dyeing human head hairs, and more particularly to a hair dyeing device which permits hair dyeing for each bundle of hairs to be completed in a single operation so that the hairs can be dyed down to their roots without affecting the scalp which is sensitive to certain ingredients in the hair dye.

2. Description of the Prior Art

Hair dyeing is usually done by hand, and the hair dyeing device that is known in this field is usually a comb specifically designed for the hair dyeing work, which simply contains a hair dye therein to be applied when it is used. However, the prior art device is not constructed to provide a constant flow of the dye. This causes more or less of the dye to adhere to the human scalp during the operation of the device. As the dye usually contains some harmful ingredients to which the scalp is sensitive, the use of such a device is not always recommended. Furthermore, the design of the prior art device is not such as to permit each hair dyeing to be completed in a single operation.

SUMMARY OF THE INVENTION

In view of the problems of the prior art device, one object of the present invention is to provide a novel and improved hair dyeing device which permits a single operation to complete the dyeing for each bundle of hairs, so that the hairs can be dyed down to their roots without affecting the scalp.

Another object of the present invention is to provide an improved hair dyeing device which includes means to protect the scalp against the sticking action of the hair dye that usually contains harmful ingredients to which the scalp is sensitive.

Still another object of the present invention is to provide a hair dyeing device which permits single dyeing operations to be performed in a successive manner.

BRIEF DESCRIPTION OF THE DRAWINGS

Those and other objects and features of the present invention will more clearly be seen by the following description to be made by referring to the accompanying drawings, in which.

DETAILED DESCRIPTION OF THE PREFERRED EMBODIMENTS

Figure 1:
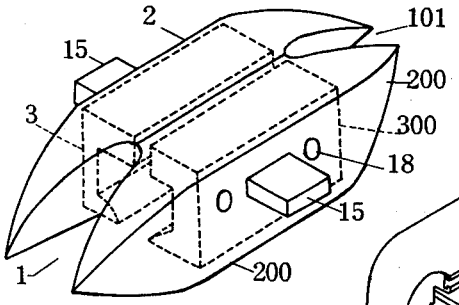
FIG. 1 is a perspective view of the hair dyeing instrument in a typical preferred embodiment of the present invention.
Figure 4:
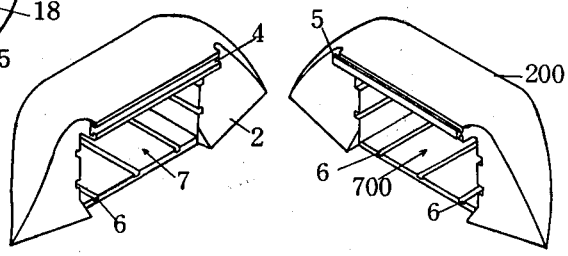
FIG. 4 is a perspective view of the two outer housing segments shown as disconnected, each having a chamber to accommodate the inner housing part.
Figure 2:
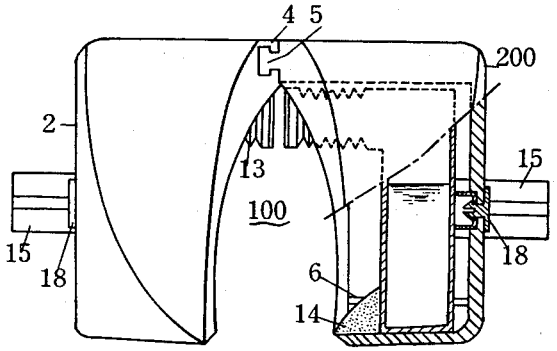
FIG. 2 is a front view, partly broken away, of the same.
Figure 5:
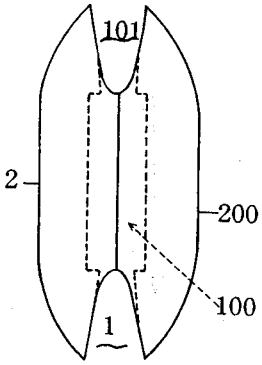
FIG. 5 is a top view of the outer housing segments shown as coupled.
Figure 6:
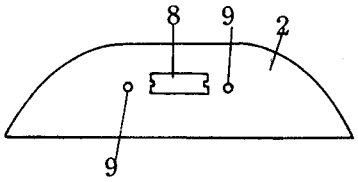
FIG. 6 is a rear view of one of the outer housing segments.

One preferred embodiment of the present invention is now described in greater detail by referring to the drawings. As particularly shown in FIG. 1, the hair dyeing device comprises an outer housing having two detachable segments 2 and 200 which are to engage each other for use and provide chambers for accommodating corresponding inner housing parts 3 and 300 later to be described. The outer housing segments 2 and 200 have a similar structure, and are coupled together to provide slits 1 and 101 at the opposite ends and a longitudinal intermediate slit 100 between the slits 1 and 101 as best shown in FIG. 2. Those slits serve as a guide through which a certain width or bundle of hairs can be gathered and guided. As more particularly viewed from FIGS. 4 and 5, each of the outer housing segments which are shown as detached and as coupled, respectively, has a generally horn-like shape having a cutout or slit at the opposite ends and an intermediate cutout or slit extending longitudinally from one to the opposite end. When the two outer housing segments 2 and 200 are combined together, the cutouts for both provide the slits 1 and 101 which allow a bundle of hairs to be guided therethrough and the longitudinal cutouts together provide an intermediate hair passage 100 connecting between the opposite slits 1 and 101. The slits 1 and 101 as combined provide a progressively narrower recess or tapered shape in plane as viewed in FIG. 5, which allows hairs to be gathered at the innermost point of the slits which is the narrowest. As described above, the outer housing includes the two detachable segments 2 and 200 to be coupled together. As particularly shown in FIG. 3 and FIG. 4, one of the two segments, which is designated by 2 for example, has a guide groove 4 extending along the upper longitudinal edge of the segment 2. The other segment, designated by 200, has a T shape rail 5 in section extending along the upper longitudinal edge thereof opposite the guide groove 4. The two segments 2 and 200 can be coupled together by engaging each other such that the T shape rail 5 is slid into the guide groove 4 from either of the opposite ends thereof. Each of the two segments 2 and 200 provides a chamber 7, 700 inside for accommodating the corresponding inner housing part 3, 300, which contains a hair dye receptacle and a dyeing teeth array which are later to be described. As viewed in FIGS. 3 and 4, each of the segments 2 and 200 has a plurality of guide grooves 6 extending transversely of the segment, which allow the corresponding inner part 3, 300 to be guided for forward and backward sliding movement. In FIG. 6 which shows one of the segments, designated by 2, the segment has at the back thereof an elongated aperture 8 through which a push button 15 on the corresponding inner housing part 3 normally protrudes, and a plurality of apertures 9 which are used for securing the inner part to the outer segment. This applies to the other segment 200 not shown. The bottom of each of the outer housing segments 2 and 200 is slightly slanted or curved upwardly at the opposite ends as viewed from FIG. 1. This curved shape is primarily intended to reduce the effective contact area of the bottom portion with the human scalp surface.

Figure 7:
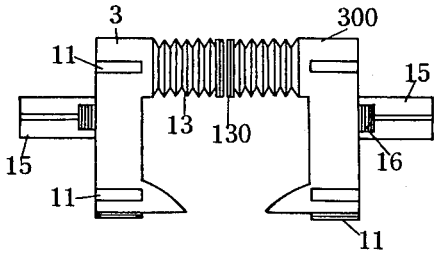
FIG. 7 is a side elevation of the two inner housing parts each including a hair dye container and an array of hair dyeing teeth.
Figure 8:
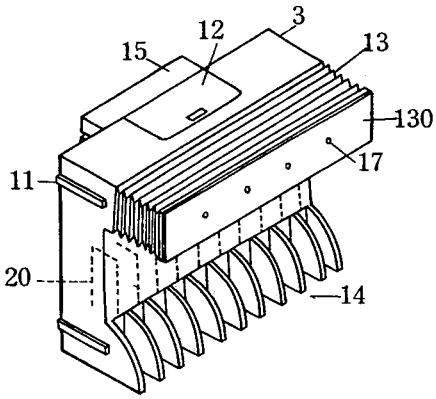
FIG. 8 is a perspective view of one of the inner housing parts in FIG. 7.
Figure 9:
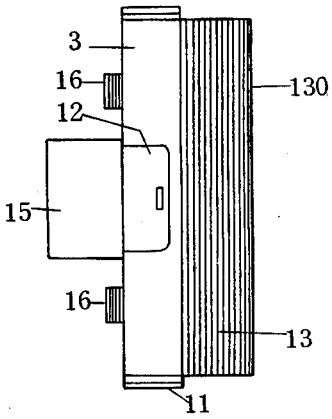
FIG. 9 is a top view of FIG. 8.

Referring particularly to FIGS. 7 and 8, the construction of the inner housing parts 3 and 300 designed to contain a hair dye receptacle and a hair dyeing teeth array is illustrated. For the convenience of simplicity, the following description will be limited to one of the inner housing parts, designated by 3, but as a matter of course also applies to the other inner part which is designated by 300. The one part of the inner housing, shown by 3, is formed like a generally reversed L shape in section, and has a plurality of rails 11 traversing the opposite sides and the bottom thereof, which correspond to the respective grooves 6 provided on the bottom surface of the chamber 7 in the outer housing segment 2 and can be guided therein for forward and backward sliding movement. The inner housing part 3 has at the top thereof an inlet with a lid generally designated by 12, through which a hair dye is supplied into the hair dye receptacle which is formed inside the inner housing parts.

As particularly seen from FIG. 8, the inner housing part 3 has an integral expandable or retractable bellows 13 extending from one side of the inner housing part in the horizontal plane aligned with the top surface thereof. At the lower portion of the inner housing part 3, there is provided an array of comb teeth 14 arranged in the longitudinal direction of the inner housing part, from which a constant flow of hair dye provided by the hair dye receptacle is fed. Furthermore, the inner housing part 3 includes the aforementioned push button 15 and resilient members 16 on the opposite sides of the button 15. The expandable or retractable bellows 13 makes the volume of the inner housing part 3 variable, as described below. The bellows 13 has at the free end side a rubber sheet 130 having a plurality of air inlet holes 17. The air inlet holes have the following function. When the push buttons 15 on both inner housing parts 3 and 300 are pushed inwardly by fingers of one hand simultaneously, the corresponding bellows 13 are then allowed to be moved forward to be closer to each other. When the opposite rubber sheets 130 of both bellows 13 are finally brought in contact with each other and the bellows are further pushed inwardly causing a further contraction, the air inlet holes 17 on both bellows are blocked to impede the air passage. This action causes a reduction in the volume of the inner housing parts, resulting in a rise in the internal air pressure. With the rising internal pressure, a flow of the hair dye in the receptacle is forced out toward the comb teeth array. After the above operation is completed, the push buttons are released from the fingers, allowing the inner housing parts 3 and 300 to be moved back to their original positions under the action of the resilient members 16 which is later to be described. This also moves the bellows 13 facing each other to be moved away from each other, thus allowing air to be introduced again through the air inlet holes 17. This expands the bellows 13 again. The position of the air inlet holes on one bellows should preferably be slightly different with regard to that of the air inlet holes on the opposite bellows, in order to ensure the impedance of the air flow through the air holes when the opposite rubber sheets 130 carrying the air holes meet each other.

The array of comb teeth 14 extending longitudinally along the lower portion of the inner housing 3, for example, includes individual teeth extending perpendicularly to the longitudinal axis of the teeth array. The individual teeth communicate with the partitioned receptacle which contains a hair dye inside the inner housing. Each of the individual teeth has a length that allows the whole part to be accommodated snugly inside the chamber 7 of the outer housing 2. As described earlier, this applies similarly to the other one of the pair, such as in the case of the chamber 700 in the other housing 200. The individual teeth on both arrays are arranged such that the teeth on one array mesh with those on the opposite array when the two inner housing parts 3 and 300 are brought the closest to each other. Those teeth are impregnated with a hair dye which is supplied from the receptacle when there is a rising internal pressure caused by compressing the bellows 13, as described earlier. In order to make this impregnation easier, the various forms of the individual teeth portions may be provided, such as by making a bundle of synthetic resin fibers, by using porous material, by using a cloth wrapper, and by using any other impregnable material.

Figure 10:
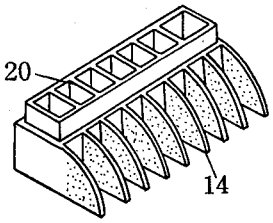
FIG. 10 is a perspective view of a variation of FIG. 8, showing the hair dye container and hair dyeing teeth array portion provided as a separate element.

In the embodiment shown in FIG. 8, the portion including the hair dye receptacle and teeth array is formed as an integral part of the inner housing 3, 300. In its varied form shown in FIG. 10, that portion may be provided as a separate element. In this variation, it is possible to provide spare elements of choice depending upon their usage. That is, those separate elements can provide replacement parts which meet any particular needs, such as hair dyes of varying concentration and teeth materials of different impregnation properties.

Figure 11:
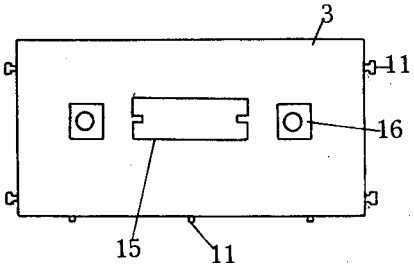
FIG. 11 is a rear view of one of the inner housing parts.

As described earlier, each of the inner housing parts 3 and 300 has the push button 15 and the resilient members 16 at the back side thereof. As viewed from FIGS. 2, 6, 7 and 9, the resilient members 16 are secured to the corresponding apertures 9 in the outer housing 2, 200 by means of any suitable fixture 18. The resilient members are normally placed in their contracted state. While a force is then being supplied by pushing both buttons 15 inwardly to expand the resilient members, the members are always trying to contract themselves against the applied force. Then, releasing the buttons allows the resilient members to return to their original state by themselves, thus moving the inner housing parts 3 and 300 under the contracting action of the members back to their respective original positions inside the chambers 7 and 700. The push buttons 15 have their exposed sides protruding through the elongated apertures 8 in the rear side of the outer housing segments 2 and 200. As particularly seen from FIG. 11, each of the push buttons has grooves which run in the longitudinal direction on the opposite sides of the button. These grooves engage the corresponding projections which extend inwardly from the opposite side edges of the elongated aperture 8. This permits a smooth sliding movement of the push buttons when they are pushed or released. The length of the push button which is wholly exposed out of the aperture 8 may be determined by the parameters such as the earlier mentioned clearance or gap 100 formed to allow a bundle of hairs and the teeth array 14 to pass therethrough.

In the basic embodiment and variation thereof which have been described, the outer housing 2 and 200 and inner housing 3 and 300 should preferably be made of transparent material which permit a visual check of the amount of the hair dye contained in the receptacle.

Alternatively, a transparent window may be provided for this purpose.

The bottom of the inner housing parts 3 and 300 should preferably be slanted similarly to the corresponding slanted bottom portion of the outer housing segments 2 and 200. This effectively permits the individual teeth in the array 14 to be brought into contact with the roots of the hairs without affecting the scalp surface. The hair dye receptacle in either its integral or separate form is partitioned as shown by 20 corresponding to the individual teeth. This partitioned construction can effectively supply an equal quantity of the hair dye to the individual teeth when the hair dyeing device is tilted for use. Thus, the individual teeth can provide uniform feeding of the dye.

Figure 3:
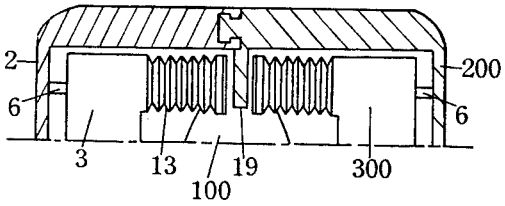
FIG. 3 illustrates the essential elements in a varied form including a down-hanging partition which permits the two inner housing parts to be operated independently of each other.

In a varied form shown in FIG. 3, a downwardly extending partition 19 is provided on one of the outer housing segments, as shown by 200, which is located in the central position at which the opposite bellows meet each other. This permits the operation of the inner housing parts 3 and 300 to be done independently of each other.

The operation of the hair dyeing device, whose construction has fully been illustrated in the foregoing description, is now described. A certain width or quantity of hairs that is desired to be hair-dyed at a time is first inserted into the gap or slit 1 formed between the outer housing segments 2 and 200. Then, the device is operated to travel forward along the human head. During this movement, the hairs caught in the slits 1 and 100 are bent according to the curved profile of the slits, but the roots of the hairs remain upright by nature. Then, the push buttons 15 are pushed by fingers of one hand in the direction to cause the inner housing parts 3 and 300 to travel inwardly. This action contracts the bellows 13, 13 to reduce the internal volumes of the inner housing parts, causing a rise in the internal air pressure. The rising internal air pressure causes the hair dye in the partitioned receptacle to flow toward the individual teeth, which are then impregnated with the hair dye. The hair dye contained in the individual teeth is then oozed out during the travel of the device or teeth along the head, adhering to the roots of the hairs without affecting the scalp itself. After the initial hair dyeing operation is completed, the push buttons are released. As the hair dyeing device advances to any succeeding bundles of hairs, these pushing and releasing operations are repeated, resulting in uniform application of the hair dye to the roots of the hairs for each operation. In this case, as described earlier, releasing the push buttons causes the resilient members 16 to be freed from the pushing force and expand themselves, urging the inner housing parts 3 and 300 to be moved away from each other so that the clearance or gap 100 can be reopened and the air inlet holes 17 can be exposed to admit air into the inner housing parts. The above steps will be repeated until all desired hair dyeing operations have been completed.

As the present invention has been described in detail with reference to the various embodied forms thereof, it provides advantages over the prior art similar devices. The hair dyeing device according to the invention permit a constant hair dye to be supplied for each dyeing process, which can be completely achieved in a single operation. The device can easily be handled by the user, whose hands can be kept clean from the hair dye compounds, and is also easy to be cleaned after use.

Although the present invention has been described by reference to the embodiments by way of example, it should be understood that various changes and modifications may be made without departing from the spirit and scope of the invention.

What is claimed is:

1. A hair dyeing device comprising:

an outer housing, including first and second detachably joined segments, having opposite front and rear ends, a bottom surface and first and second side surfaces extending upward from said bottom surface on said first and second segments, respectively, and having a longitudinally extending passage formed between said first and second segments, open along said bottom surface, to define a longitudinally extending gap therein and opening at said front and rear ends for allowing a bundle of hair to be guided therethrough from said front end to said rear end;

said first and second segments respectively having opposing first and second chambers formed therein opening into said passage;

an inner housing, including opposing first and second parts respectively in said first and second chambers, slidable toward and away from each other in said first and second chambers, said first and second parts being contractable in response to sliding movement thereof;

first and second hair dye feeding means, respectively coupled to said first and second parts for sliding movement therewith, for feeding hair dye to the bundle of hair in said passage in response to the contraction of said first and second parts;

said first and second hair dye feeding means respectively including first and second hair dye receptacles for storing the hair dye and first and second arrays of hair dyeing teeth in respective fluid communication with said first and second receptacles, engagable with the bundle of hair for delivering the dye to the bundle of hair; and means for sliding said first and second parts toward and away from each other.

2. A hair dyeing device as in claim 1, wherein said first and second parts respectively include first and second bellows respectively enclosing first and second internal gas filled spaces in respective fluid communication with said first and second receptacles, and means for contracting said first and second bellows whereby gas from said first and second bellows forces the dye in said first and second receptacles to said first and second arrays of teeth.

3. A hair dyeing device as in claim 2, wherein said first and second bellows have air inlet apertures for receiving air from the external atmosphere into said first and second internal spaces, said device further comprising means for covering said inlet apertures to block the passage of air therethrough when said first and second parts are slid toward each other.

4. A hair dyeing device as in claim 3, wherein said first and second bellows respectively comprise first and second parallel opposing surfaces, said covering means comprising said first and second parallel opposing surfaces, said air inlet apertures being formed in said first and second opposing surfaces, said first and second opposing surfaces being brought into flush abutment with each other to block air passage through said apertures when said first and second parts are slid toward each other.

5. A hair dyeing device as in claim 3, wherein said covering means comprises means, mounted to said outer housing and extending midway between said first and second bellows, for intercepting said first and second bellows so as to block said apertures when said first and second parts are slid toward each other.

6. A hair dyeing device as in claim 1, wherein said first and second parts comprise first and second means, respectively responsive to contraction thereof, for applying pressurized air into said first and second receptacles so as to force the dye therein to said first and second arrays of teeth.

7. A hair dyeing device as in claim 1, wherein said bottom surface curves upward at said front and rear ends.

8. A hair dyeing device as in claim 1, wherein said outer housing has a top surface opposite said bottom surface, formed on said first and second segments; said passage opening into said top surface at said front and rear ends; said first and second segments being detachably joined at said top surface between said front and rear ends.

9. A hair dyeing device as in claim 1, wherein said first and second parts are slidable in horizontal directions transverse to said longitudinally extending passage.

10. A hair dyeing device as in claim 1, or claim 2 or claim 9, wherein said sliding means includes means for resiliently urging said first and second parts appart.

11. A hair dyeing device as in claim 1, wherein said longitudinally extending passage widens at said first and second ends so that said longitudinally extending gap in said bottom surface widens at said first and second ends.

12. A hair dyeing device as in claim 9 or claim 11, wherein said sliding means further comprise first and second push buttons respectively mounted to said first and second parts, respectively protruding transversely and horizontally through said first and second side surfaces, said first and second push buttons being responsive to horizontal and transverse pressure applied thereto, for sliding said first and second parts toward each other.

13. A hair dyeing device as in claim 9, wherein said first and second arrays of hair dyeing teeth of said first and second hair dye feeding means is arranged longitudinally in transversely opposing relation so as to mesh with the teeth of the opposing array when said first and second parts are slid toward each other.

14. A hair dyeing device as in claim 12, wherein said teeth comprise a material which is impregnable by liquid hair dye.

15. A hair dyeing device as in claim 12, wherein said teeth comprise a porous material.

16. A hair dyeing device as in claim 1, wherein said first and second hair dye receptacles each comprise a plurality of partitioned spaces, each of said partitioned spaces being in fluid communication with a separate hair dyeing tooth of one of said first and second arrays of hair dyeing teeth.

17. A hair dyeing device as in claim 1, wherein said first and second hair dyeing means are respectively integrally formed with said first and second parts.

18. A hair dyeing device as in claim 1, wherein said first and second hair dyeing means respectively comprise a first integrally formed element and a second integrally formed element, respectively removably mounted to said first and second parts.

19. A hair dyeing device comprising:

an outer housing, including first and second joined segments, having opposite front and rear ends, having a bottom surface and having a longitudinally extending passage formed between said first and second segments, open along said bottom surface to define a longitudinally extending gap therein, and opening at said front and rear ends for allowing a bundle of hair to be guided therethrough from said front end to said rear end;

said first and second segments respectively having opposing first and second chambers formed therein opening into said passage;

an inner housing, including opposing first and second inner housing parts respectively slidably mounted in said first and second chambers, so as to be respectively slidable in said first and second chambers toward and away from each other in horizontal directions extending transversely of said longitudinally extending passage, said first and second inner housing parts being contractable in response to sliding movement thereof;

first and second hair dye feeding means, respectively coupled to said first and second parts for sliding movement therewith, for feeding hair dye to the bundle of hair in said passage in response to the contraction of said first and second parts, said first and second dye feeding means respectively including first and second hair dye receptacles for storing the hair dye and first and second arrays of hair dyeing teeth in respective fluid communication with said first and second receptacles, engagable with the bundle of hair for delivering the dye to the bundle of hair, and means for sliding said inner housing parts toward and away from each other.

* * * * *